US005242352A

United States Patent [19]

Elliott

[11] Patent Number: 5,242,352

[45] Date of Patent: Sep. 7, 1993

[54] AQUATIC BUOYANCY EXERCISE APPARATUS

[76] Inventor: Tim H. Elliott, 910 N. Ashbel, Baytown, Tex. 77520

[21] Appl. No.: 996,607

[22] Filed: Dec. 24, 1992

[51] Int. Cl.[5] ..... A63B 23/00

[52] U.S. Cl. ..... 482/111; 482/55; 472/128

[58] Field of Search ..... 472/128; 482/55, 56, 482/111, 148, 54, 97; 434/254

[56] References Cited

U.S. PATENT DOCUMENTS

| | | | |
|---|---|---|---|
| 3,861,675 | 1/1975 | Hopper | 482/55 |
| 4,576,376 | 3/1986 | Miller | 482/97 |
| 4,804,177 | 2/1989 | Rosson | 482/55 |
| 4,838,545 | 6/1989 | Wilson | 482/54 |

FOREIGN PATENT DOCUMENTS 8203790 11/1982 None .

*Primary Examiner*—Stephen R. Crow
*Assistant Examiner*—Glenn E. Richman
*Attorney, Agent, or Firm*—Kenneth A. Roddy

[57] ABSTRACT

An aquatic exercise apparatus for use in a pool of water by a person in the water for post operative and post injury muscular skeletal therapy and rehabilatation as well as conditioning and toning the muscles has a base member adapted to be removably anchored at the bottom of a pool of water with one or more pulleys removably connected on the base member and one or more flexible lines having a handle at one end which passes through the pulley(s) and is attached at its other end to at least one buoyant float member. A person in the pool of water physically manipulates the handles to overcome the resistive upward buoyant force of the buoyant float member(s) in various exercises to condition and tone the muscles. In one embodiment the base member is a platform upon which the person exercising stands, and in another embodiment the base member is a suction cup member adapted to be removably secured to the bottom surface of the pool of water. The buoyancy of each float member can be selectively altered to provide a range of buoyancy forces.

16 Claims, 3 Drawing Sheets

AQUATIC BUOYANCY EXERCISE APPARATUS

BACKGROUND OF THE INVENTION

1. Field of the Invention

This invention relates generally to aquatic exercise apparatus, and more particularly to an aquatic exercise apparatus having a system of floats, pulleys, and cables which is anchored in a body of water and utilizes the resistive buoyant force of the buoyant float members for exercising and toning the muscles.

2. Brief Description of the Prior Art

The beneficial effects of hydro-exercise in a pool of water is well documented. The resistance of the water to movement provides soothing therapeutic massage of the muscles and the buoyancy of the person exercising prevents excessive impact on the joints.

Various exercise devices have been developed which have fins or water deflector surfaces to increase the resistive forces, torque, and torsion, as the person exercises in a pool of water. The patents of Baker, U.S. Pat. No. 3,913,970, Solloway, U.S. Pat. No. 4,411,422, Guzman, U.S. Pat. No. 4,721,300, and MacKechnie, U.S. Pat. No. 5,033,739, disclose these type of water resistance devices.

Others have developed apparatus which are installed on the bottom of a pool of water and utilize buoyancy of the person exercising, however, they have a limited range of the type of exercise performed and the muscle groups affected by the exercise.

Miller, U.S. Pat. No. 4,576,376 discloses a treadmill at the bottom of a tank of water whereby a person subjected to buoyancy can walk or run on the treadmill.

Wilson, U.S. Pat. No. 4,838,545 discloses an exercise device utilizing adjustable dead weights which is bolted to a deck adjoining a pool of water and enables a person of moderate strength to do chin-up exercises while suspended in the water by pulling down on a grasping bar extended out over the water which is attached to a lever arm having weights on the other end of the lever arm.

Bass, U.S. Pat. No. 4,551,108 discloses a buoyant vest suspended by cables whereby a person in a pool of water wears the vest and exercises by moving his or her arms and legs through the water.

Others have developed flotation devices which are attached to or held by a person exercising in a pool of water which also have a limited range of the type of exercise performed and the muscle groups affected by the exercise.

Ward, U.S. Pat. No. 3,427,022 discloses a pair of spherical hollow buoyant floats having an opening for introducing water to adjust the buoyancy and handles for receiving the hand or foot of a person in a pool of water whereby the person can exercise while supported by the floats.

Beasley, U.S. Pat. No. 4,768,774 discloses tubular flexible buoyant float with integral hand grips at each end. The tubular float partially encircles and supports the user's body while exercising. Weights may be attached to the tubular float and concave disc-like water resistance members may be attached to the handles.

The present invention is distinguished over the prior art in general, and these patents in particular by an aquatic exercise apparatus for use in a pool of water by a person in the water for post operative and post injury muscular skeletal therapy and rehabilatation as well as conditioning and toning the muscles which has a base member adapted to be removably anchored at the bottom of a pool of water with one or more pulleys removably connected on the base member and one or more flexible lines having a handle at one end which passes through the pulley(s) and is attached at its other end to at least one buoyant float member. A person in the pool of water physically manipulates the handles to overcome the resistive upward buoyant force of the buoyant float member(s) in various exercises to condition and tone the muscles. In one embodiment the base member is a platform upon which the person exercising stands, and in another embodiment the base member is a suction cup member adapted to be removably secured to the bottom surface of the pool of water. The buoyancy of each float member can be selectively altered to provide a range of buoyancy forces.

SUMMARY OF THE INVENTION

It is therefore an object of the present invention to provide an aquatic exercise apparatus which utilizes the beneficial effects of hydrotherapeudic movement and the resistive buoyant force of buoyant float members for post operative and post injury muscular skeletal therapy and rehabilatation as well as exercising and toning the muscles.

It is another object of this invention to provide an aquatic exercise apparatus which is quickly and easily installed in a body of water and used by a person at least partially immersed in the water.

Another object of this invention is to provide an aquatic exercise apparatus which allows a wide range of exercises to be performed and will rehibilitate, tone, and condition nearly all major muscle groups.

Another object of this invention is to provide an aquatic exercise apparatus which gives soothing massage of the muscles while exercising and prevents excessive impact on the joints.

Another object of this invention is to provide an aquatic exercise apparatus which requires the person exercising to overcome the upward buoyant force of buoyant float members rather than dead weights.

A further object of this invention is to provide an aquatic exercise apparatus which utilizes the upward buoyant force of buoyant float members wherein the buoyancy and thus the force required to overcome the buoyancy can be adjusted to fit the requirements of a particular individual.

A still further object of this invention is to provide an aquatic exercise apparatus which is simple in construction, economical to manufacture, and safe and durable in use.

Other objects of the invention will become apparent from time to time throughout the specification and claims as hereinafter related.

The above noted objects and other objects of the invention are accomplished by an aquatic exercise apparatus for use in a pool of water by a person in the water for post operative and post injury muscular skeletal therapy and rehabilatation as well as conditioning and toning the muscles has a base member adapted to be removably anchored at the bottom of a pool of water with one or more pulleys removably connected on the base member and one or more flexible lines having a handle at one end which passes through the pulley(s) and is attached at its other end to at least one buoyant float member. A person in the pool of water physically manipulates the handles to overcome the resistive upward buoyant force of the buoyant float member(s) in various exercises to condition and tone the muscles. In one embodiment the base member is a platform upon which the person exercising stands, and in another embodiment the base member is a suction cup member adapted to be removably secured to the bottom surface of the pool of water. The buoyancy of each float member can be selectively altered to provide a range of buoyancy forces.

DESCRIPTION OF THE PREFERRED EMBODIMENT

Figure 1:
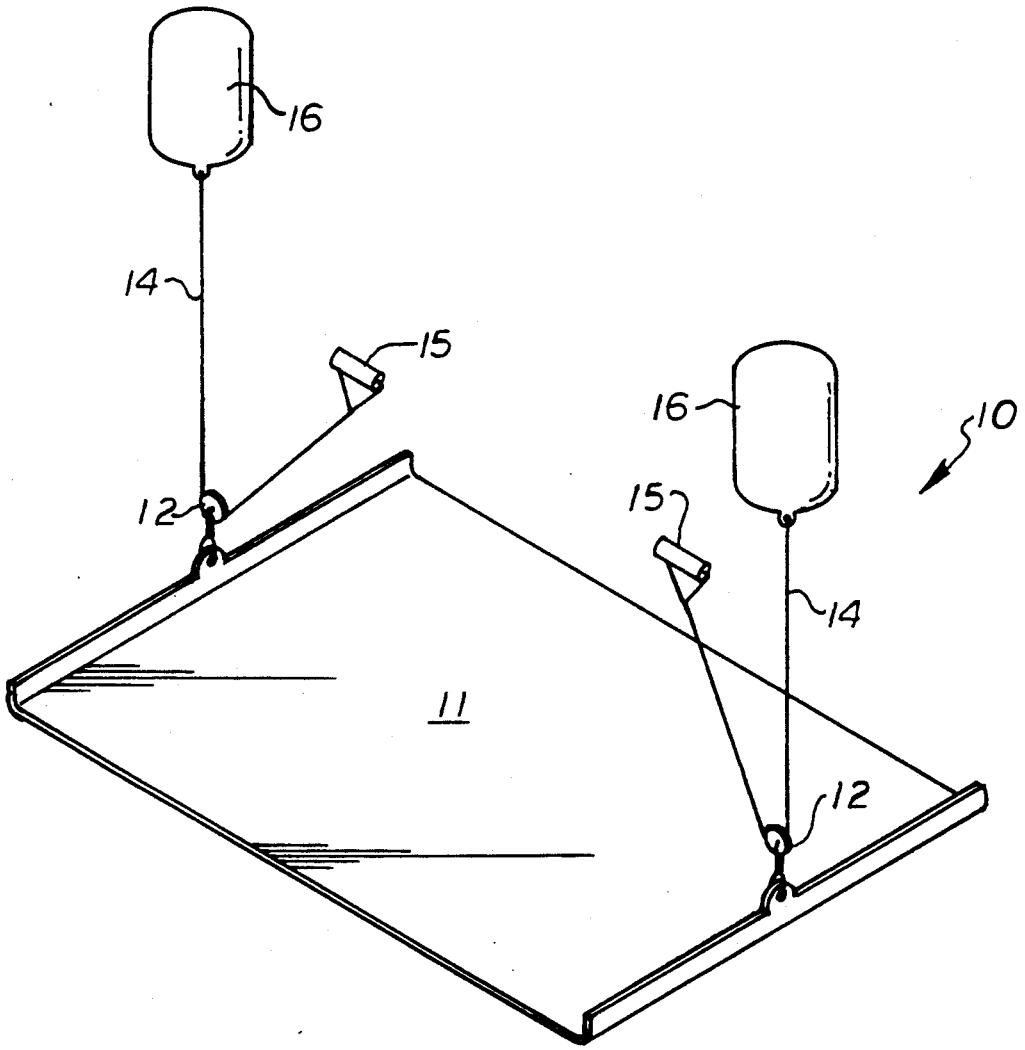
FIG. 1 is an isometric view of one embodiment of an aquatic exercise apparatus in accordance with the present invention.

Referring to the drawings by numerals of reference, there is shown in FIG. 1, a preferred embodiment of an aquatic exercise apparatus 10 for use in a pool of water W by a person P in the water for post operative and post injury muscular skeletal therapy and rehabilatation as well as conditioning and toning the muscles. In the embodiment of FIG. 1, the apparatus 10 has a generally square or rectangular base member 11 which is placed on the bottom surface of the pool enclosure and upon which the person P stands. A pair of laterally spaced pulleys 12 are removably connected to the base 11 at each side.

Figure 2:
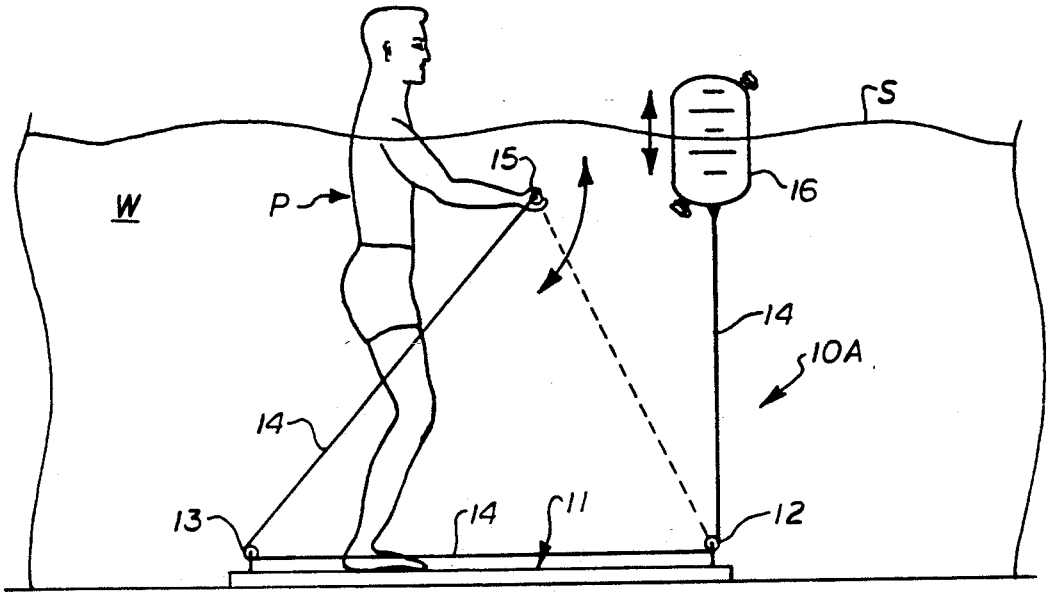
FIG. 2 is a side elevation of another embodiment of the aquatic exercise apparatus in accordance with the present invention which has a larger base member.
Figure 3:
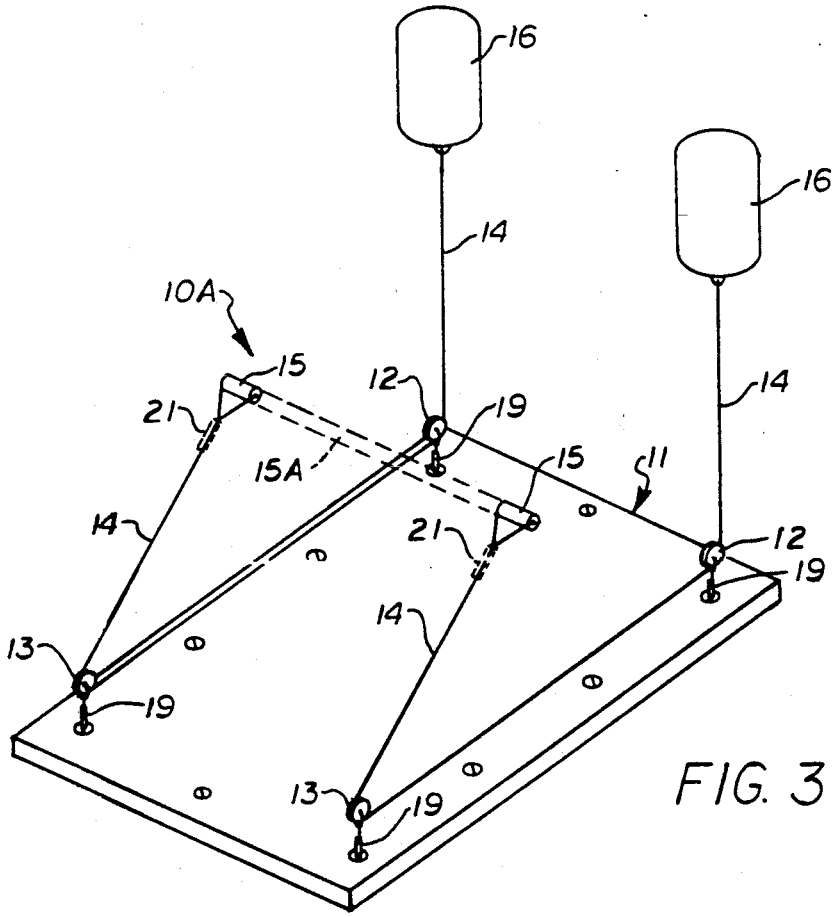
FIG. 3 is an isometric view of the aquatic exercise apparatus of FIG. 2.

FIGS. 2 and 3 show another preferred embodiment of the aquatic exercise apparatus 10A which has a larger generally square or rectangular base member which is placed on the bottom surface of the pool enclosure and upon which the person P stands. A pair of laterally spaced pulleys 12 are removably connected to the base 11 near one end, and another pair of pulleys 13 are removably connected to the base near its opposite end.

In the embodiments of FIGS. 1, 2, and 3, a pair of flexible cables or water-proof ropes 14 each having a handle 15 at one end pass through the pulleys 12 and 13. Depending upon the particular exercise to be carried out, a single handle 15A may be used as indicated by dotted line in FIG. 3, or preferably, the handles 15 are adapted to be releasably connected together end-to-end to form a single handle. Ankle straps or wrist straps may also be provided.

The other end of each cable 14 is releasably connected to the bottom of a buoyant float 16. As explained hereinafter, the buoyant floats 16 contain air or a quantity of air and water and thus will float on the surface S of the pool of water W or at the surface in a partially submerged condition.

From the foregoing description, it can be understood that the floats 16 will normally exert an upward buoyant force, and that a person P standing on the base 11 will prevent the base from moving and can physically manipulate the handles 15 to overcome the resistive upward buoyant force of the floats in various exercise movements to condition and tone the muscles.

It should be understood, that while a dual cable, pulley, and float system is illustrated as an example, that the present invention may also be provided with a single cable 14, pulley 12, and float 16. It should also be understood, that although the handles are shown being gripped by the hands of the user, that the handles may also be engaged on other parts of the body. For example, the handles may be installed on the foot of the person for doing forward or rearward leg lifts, or placed at the back of the head for exercising the neck muscles.

Figure 4:
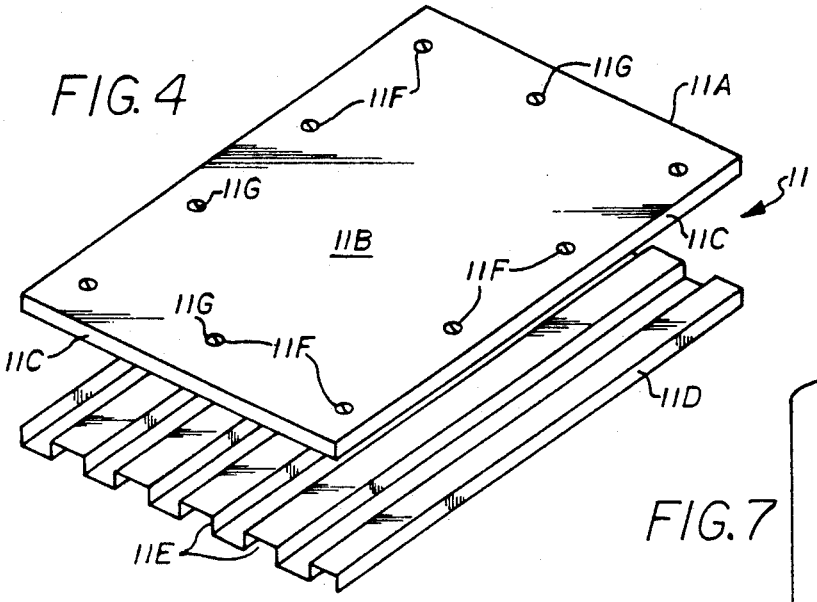
FIG. 4 is an exploded isometric view of the base member of the aquatic exercise apparatus of FIG. 2.

As seen in FIG. 1, the base member 11 may be a single sheet of non-buoyant material, or as best seen in FIG. 4, the base member 11 may be formed of a top member 11A having a top surface 11B with opposed side walls 11C which is installed on a bottom member 11D having longitudinal corrugations 11E. The top and bottom members 11A and 11D are bonded together to form a single unit, and the bottom member 11D serves to structurally reinforce and strengthen the top member 11A. The top surface 11B may be textured to prevent slipping, and the bottom member 11D may be apertured or dimensioned to facilitate water drainage when removed from the water. The top and bottom members are preferably formed of a suitable rigid non-buoyant plastic material. The top surface 11B of the top member 11A is provided with a series of longitudinally spaced cup-shaped depressions 11F near the opposed sides. A pin 11G extends transversly across the open ends of each depression.

Figure 5:
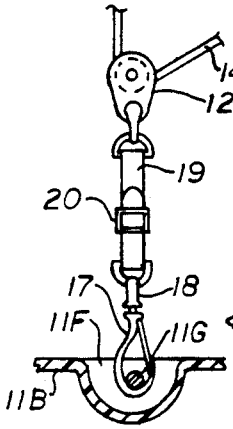
FIG. 5 is a side elevation of a pulley connected to the base member of the aquatic exercise apparatus.

As seen in FIG. 5, the pulleys 12,13, have a hook latch 17 at their lower end which is releasably engaged on the pin 11G to connect the pulleys to the base 11. The hook latch 17 may have a swivel connection 18. A strap or belt of webbing or other flexible material 19 may also be installed between the pulley and the hook latch 17 and provided with a buckle 20 for adjusting the vertical distance of the pulleys relative to the top surface 11B of the base 11. The hook latch 17 allows the pulleys to be selectively connected in various ones or pairs of the depressions 11F for changing the pulley location relative to the person standing on the base 11 (i.e., forward, rearward, or to the side of the person), depending upon the type of exercise to be carried out. For example, as seen in FIG. 2, pulleys 13 rearward of the person P will allow the triceps to be exercised with an upward pull, and using only pulleys 12 forward of the person (dotted line) will allow the biceps to be exercised.

Figure 6:
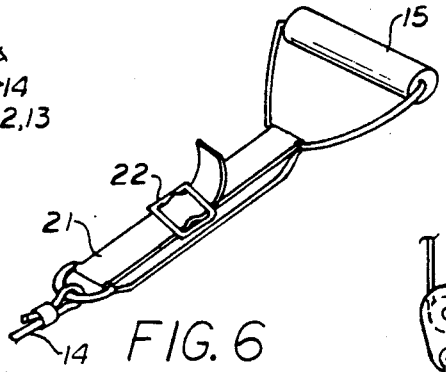
FIG. 6 is an isometric view of a handle member connected to the flexible cable base member of the aquatic exercise apparatus.

As best seen in FIG. 6, the handles 15 may also be connected to the cable or rope 14 by a strap or belt of webbing or other flexible material 21 provided with a buckle 22 for selectively adjusting the length of the cable or rope, depending upon the depth of the water, height of the person exercising, type of exercise, and the body part gripping the handles, etc.

Figure 7:
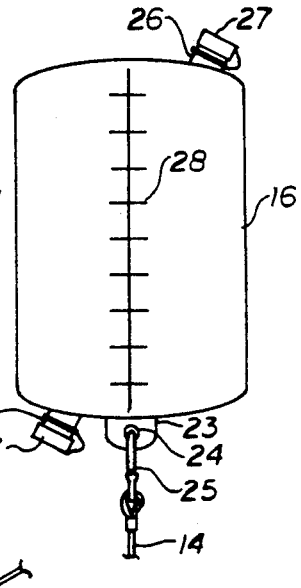
FIG. 7 is a side elevation of a float member of the aquatic exercise apparatus.

A preferred float member 16, as shown in FIG. 7 is a hollow, generally cylindrical container having a depending solid portion 23 at the bottom end with an aperture 24 therethrough for receiving a hook latch 25 which is connected to one end of the cable or rope 14. The float 16 has at least one opening, or fill neck 26 at one end whereby water may be selectively poured into the float. A lid or cap 27 is removably installed on the fill neck 26 to form an air-tight seal for the container. The float 26 may also be provided with a fill neck 26 and cap 27 at each end whereby the cap 27 at the top end can be removed or loosened to provide a vent such that the cap at the bottom end can be removed and the float filled from the bottom opening with the air vented out the top. The float 16 is preferably formed of transparent or translucent plastic of sufficient strength to prevent it from collapsing when pulled beneath the water. The float 16 may also have calibrated markings 28 on the outer surface indicating the weight in pounds corresponding to the level of water (volume) in the float. Any number of floats 16 may be connected to the end of each rope or cable 14 depending upon the amount of force desired to be used in the exercises.

Figure 9:
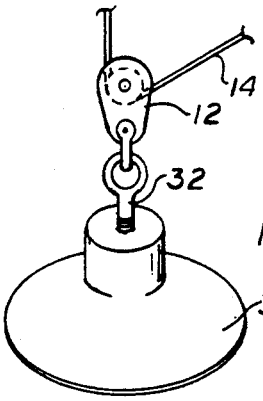
FIG. 9 is an isometric view of the base member of the aquatic exercise apparatus of FIG. 8.
Figure 8:
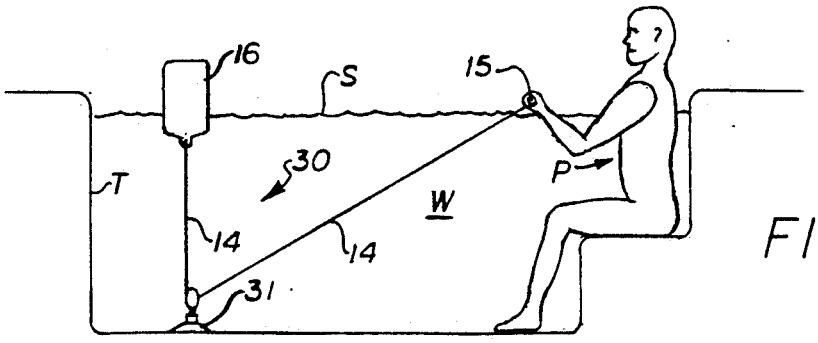
FIG. 8 is a side elevation of another embodiment of the aquatic exercise apparatus in accordance with the present invention which is suited for use in a spa or hot tub.

Referring now to FIGS. 8 and 9, there is shown another embodiment of the aquatic exercise apparatus 30 for use in a pool of water W which has a smooth bottom surface and side wall, such as a spa or hot tub T and can be used by a person P sitting in the water. In this embodiment, the base member 11 is replaced by one or more suction cup members 31 which are releasably attached to the bottom surface or to the side wall of the spa or tub enclosure T. An eye member 32 is secured in the top of each suction cup 31, and a pulley 12 is removably connected to the eye of each suction cup.

As with the previous embodiment, a flexible cable or water-proof rope 14 having a handle 15 at one end passes through the pulley 12 and is releasably connected to the bottom of a buoyant float 16. It should be understood, that while a single suction cup and cable/pulley system is shown, the suction cups may be provided in pairs for a dual cable, pulley, and float system.

As previously described with reference to FIGS. 5, 6, and 7, in the embodiment of FIGS. 8 and 9, the pulley 12 may be adjustably connected to the suction cups 31. The pulley 12 would have a hook latch 17 at its lower end releasably engaged on the eye 32 at the top of the suction cup 31, and may have a swivel connection 18. A strap or belt of webbing or other flexible material 19 may also be installed between the pulley and the hook latch 17 and provided with a buckle 20 for adjusting the distance of the pulleys relative to the bottom surface or side wall of the spa or tub. The handle 15 may also be connected to the cable or rope 14 by a strap or belt of webbing or other flexible material 21 provided with a buckle 22 for selectively adjusting the length of the cable or rope, depending upon the depth of the water, location of the suction cup, height of the person exercising, type of exercise, and the body part gripping the handles, etc. The embodiment of FIGS. 8 and 9 also uses the same float member 16 as shown and previously described with reference to FIG. 7.

The present invention operates on Archimedes' principle of buoyancy which states that a body wholly or partly immersed in a fluid is buoyed up with a force equal to the weight of the fluid displaced by the body. Thus, the downward force required to pull the float beneath the surface of the water would be greater than the upward force of buoyancy. For example, if the float were a 1 gallon container filled with air, the buoyancy would be calculated as follows:

Where

B = buoyancy,

1 $in^3$ = 16.39 $cm^3$,

1 KG = 2.205 lbs.

density of air = 0.001 $gm/cm^3$, $d_w$ = density of water = 1.000 $gm/cm^3$, and $V_f$ = volume of float = 1 fluid gallon = 231 $in^3$ 231 × 16.39 = 3,786 $cm^3$ $$\begin{aligned} B &= d_w \times V_f \\ &= (1.000\ gm/cm^3) \times (3{,}786\ cm^3) \\ &= 3{,}786\ gm = 3.786\ KG \\ &= 3.786 \times 2.205 = 8.348\ lbs. \end{aligned}$$

Therefore, the force required to pull the float beneath the surface would be slightly greater than 8.348 lbs., or about 8½ lbs.

Thus, if two floats of 1 gallon size were used, the resistive (buoyant) force would be about 17 lbs, and if two 2 gallon floats were used, the resistive force would be about 34 lbs, etc. The floats may be partially filled with water to reduce the resistive force. For example, if a 1 gallon float were half filled with water, the resistive force would be about 4 lbs, etc.

The force required to pull the float beneath the surface of the water is also affected by the drag of the float through the water. In other words, the harder and faster that the float is pulled beneath the water, the more force is required.

The present invention is not particularly suited for weight training, but instead combines the beneficial effects of hydrotherapy exercise accompanied by weight resistance to aid in post operative and post injury muscular skeletal therapy and rehabilatation as well as to tone and condition the muscles.

While this invention has been described fully and completely with special emphasis upon a preferred embodiment, it should be understood that within the scope of the appended claims the invention may be practiced otherwise than as specifically described herein.

I claim:

1. An aquatic exercise apparatus for use in a pool of water by a person in the water for post operative and post injury muscular skeletal therapy and rehabilatation as well as conditioning and toning the muscles comprising;

a base member adapted to be removably anchored at the bottom of a pool of water, pulley means on said base member, at least one buoyant float member adapted to normally float on the surface of the pool of water, at least one flexible line connected with said pulley means having grip means at one end for receiving a body part of a person and connected at its other end to said at least one buoyant float member, whereby the person in a pool of water may physically manipulate said grip means to overcome the resistive buoyant force of said at least one buoyant float member in various exercises to rehabilitate various muscular skeletal groups and generally condition and tone the muscles.

2. An aquatic exercise apparatus according to claim 1 wherein said base member is a platform anchored by the weight of the user occupying the platform.

3. An aquatic exercise apparatus according to claim 1 wherein said base member comprises a platform upon which the person exercising stands.

4. An aquatic exercise apparatus according to claim 1 wherein said base member comprises a suction cup member adapted to be removably secured to the bottom surface of the pool of water.

5. An aquatic exercise apparatus according to claim 1 wherein said pulley means are removably connected with said base member for connection at selective positions relative to the person exercising.

6. An aquatic exercise apparatus according to claim 1 wherein said pulley means comprise at least one pulley member releasably connected with said base member for connection at selective positions relative to the person exercising.

7. An aquatic exercise apparatus according to claim 1 wherein said pulley means includes adjustment means for selectively adjusting the vertical distance of said pulley member relative to said base member.

8. An aquatic exercise apparatus according to claim 1 wherein said pulley means comprise at least one pair of laterally spaced pulley members releasably connected with said base member for connection at selective positions relative to the person exercising, and said flexible line comprises a flexible line connected with each said pair of pulley members.

9. An aquatic exercise apparatus according to claim 8 wherein said grip means comprise at least one rod-like handle member connected at one end of each said flexible line.

10. An aquatic exercise apparatus according to claim 9 wherein each said handle member is adapted to be releasably connected to the other in end to end relation to form an elongate bar for receiving a body part of the person exercising.

11. An aquatic exercise apparatus according to claim 1 wherein each said flexible line is selectively adjustable in length to correspond to the depth of the water, height of the person exercising, type of exercise, and the body part engaged with said grip means.

12. An aquatic exercise apparatus according to claim 1 wherein said float member contains a volume of material having a density less than the water and is buoyed up with a force equal to the weight of the water displaced by said float and requires the person exercising to exert a downward force greater than the upward force of buoyancy to pull the float beneath the surface of the water.

13. An aquatic exercise apparatus according to claim 12 wherein said float member is adapted to have the volume of material selectively altered to provide a selective range of buoyancy forces.

14. An aquatic exercise apparatus according to claim 12 wherein said float member comprises a hollow container which contains a volume of air.

15. An aquatic exercise apparatus according to claim 14 wherein said float member has an opening with a sealed closure to allow selective displacement of air with water to alter the volume of air and provide a selective range of buoyancy forces.

16. An aquatic exercise apparatus according to claim 15 wherein said float member is transparent or translucent and has calibrated markings on an outer surface indicating the weight in pounds corresponding to the volume of water and air contained therein.

* * * * *